US005490816A

United States Patent [19]

Sakumoto

[11] Patent Number: 5,490,816

[45] Date of Patent: Feb. 13, 1996

[54] PACE GENERATING DEVICE

[75] Inventor: Kazumi Sakumoto, Chiba, Japan

[73] Assignee: Seiko Instruments Inc., Japan

[21] Appl. No.: 197,696

[22] Filed: Feb. 17, 1994

[30] Foreign Application Priority Data

Mar. 22, 1993 [JP] Japan ..... 5-062266

[51] Int. Cl.[6] ..... A63B 21/00

[52] U.S. Cl. ..... 482/3; 482/1; 482/8; 482/75; 482/901; 482/902

[58] Field of Search ..... 482/1–9, 74, 900–902; 364/561, 565, 566; 377/24.2, 5

[56] References Cited

U.S. PATENT DOCUMENTS

| | | | |
|---|---|---|---|
| 3,797,010 | 3/1974 | Adler et al. | 482/74 X |
| 4,220,996 | 9/1980 | Searcy | 482/74 X |
| 4,334,190 | 6/1982 | Sochaczeuski | 482/74 X |
| 4,408,183 | 10/1983 | Wills | 482/3 X |
| 4,962,469 | 10/1990 | Ono et al. | 364/561 |
| 5,164,967 | 11/1992 | Endo et al. | 377/24.2 |

*Primary Examiner*—Richard J. Apley
*Assistant Examiner*—Glenn E. Richman
*Attorney, Agent, or Firm*—Adams & Wilks

[57] ABSTRACT

A pace generating device which output a desirable pace signal automatically without stopping an exerciser from exercising and which can save consumption power. A walking detector outputs a walking signal. A walking pace calculator calculates a pace from a period of the detected walking signal and stores it. A pace comparing means compares a predetermined pace with a detected walking pace, and outputs a pace generating signal when the result of the above comparison between the detected walking pace and the predetermined pace is out of a predetermined range.

14 Claims, 12 Drawing Sheets

WALKING SIGNAL AFTER WAVEFORM SHAPING

PACE GENERATING DEVICE

BACKGROUND OF THE INVENTION

The present invention relates to a pace generating device for generating pace signals with predetermined periodicity.

Exercise walking such as Jogging has been popularized recently to the public for the purpose of improving their health. A pace generating device shown in FIG. 12 for generating pace sounds with predetermined periodicity has been put to practical use in order to assist exercises. In FIG. 12, showing a conventional pace generating device, a user inputs a desirable pace thereto by inputting pace data in a pace data inputting means 108 and by looking at a display means 102. This inputted pace is transformed into a pace signal by a standard clock signal of a timing signal generating means 101. Next, an input means 100 starts a pace outputting means 103 which outputs a pace with electronic sounds with which a user exercise in accordance.

However, such a conventional pace generating device has a problem that a user must stop exercising and operate the input means 100 in order to hear the pace sounds. When the pace sounds are once outputted, the pace sounds keep on being outputted until the user stops exercising and operates the input means. This increases the consumption of power and makes it difficult to drive the device by an electric battery.

SUMMARY OF THE INVENTION

The object of the present invention is to provide a pace generating device which can output a desired pace signal automatically without requiring a user to stop exercising and of which the consumption power is small so as to be installed in a miniature electronic apparatus employing an electrical battery as a driving source.

In order to solve the problems described hereinbefore, firstly the present invention is constituted of a walking detector means for detecting a walking, walking pace calculating means for calculating a walking pace from detected walking signals, walking pace storing means for storing a calculated walking pace, and pace comparing means for comparing a detected walking pace stored with a predetermined walking pace stored in a pace data storing means and for outputting a pace making instruction signal to a pace generating means if the difference between the detected walking pace and the predetermined walking pace is out of a predetermined range.

The invention further comprises timer means for conducting timer operation by an output from the pace comparing means and pace outputting prohibition means for prohibiting outputting a pace signal to a pace outputting means by time-up output of the timer means.

FIG. 1 is a function block diagram showing one example of a typical construction of the present invention. The walking detect means 103 detects walking and then outputs a detected walking signal to the walking pace calculating means 104. A standard clock signal outputted by timing signal generating means 101 is inputted to the walking pace calculating means 104. Then the walking pace calculating means 104 measures a period of the detected walking signal and calculates a pace. The walking pace storing means 105 stores the walking pace calculated by the walking pace calculating means 104. The pace comparing means 106 compares a predetermined pace stored in the pace data storing means 107 with the detected walking pace stored in the walking pace storing means 105 and then outputs a pace generating or making instruction signal to the pace signal generating means 109 if the result of the above comparison is out of the predetermined range. A pace making instruction signal is inputted to the pace signal generating means 109. Then the pace signal generating means 109 makes a pace signal from a standard clock signal of the timing signal generating means 101 according to a predetermined pace stored in the pace data storing means 107 and then outputs a pace signal to the pace outputting means 110. The pace signal generating means 109 outputs a pace signal.

FIG. 2 is another function block diagram showing another example of a typical construction of the present invention. The pace comparing means 106 compares a predetermined pace stored in the pace data storing means 107 with a detected walking pace stored in the walking pace storing means 105 and outputs a pace making instruction signal to the pace signal generating means 109 if the result of the above comparison is out of the predetermined pace range. At the same time, the pace comparing means 106 outputs a timer start signal to the timer means 209. The timer means 209 receives a timer start signal, then counts a standard clock signal outputted form the timing signal generating means 101, and outputs a time-up signal when the timing operation is ended. The pace outputting prohibition means 211 receives a time-up signal and then prohibits inputting a pace signal outputted from the pace signal generating means 109 to the pace outputting means 110.

DETAILED DESCRIPTION OF THE PREFERRED EMBODIMENTS

Figure 1:
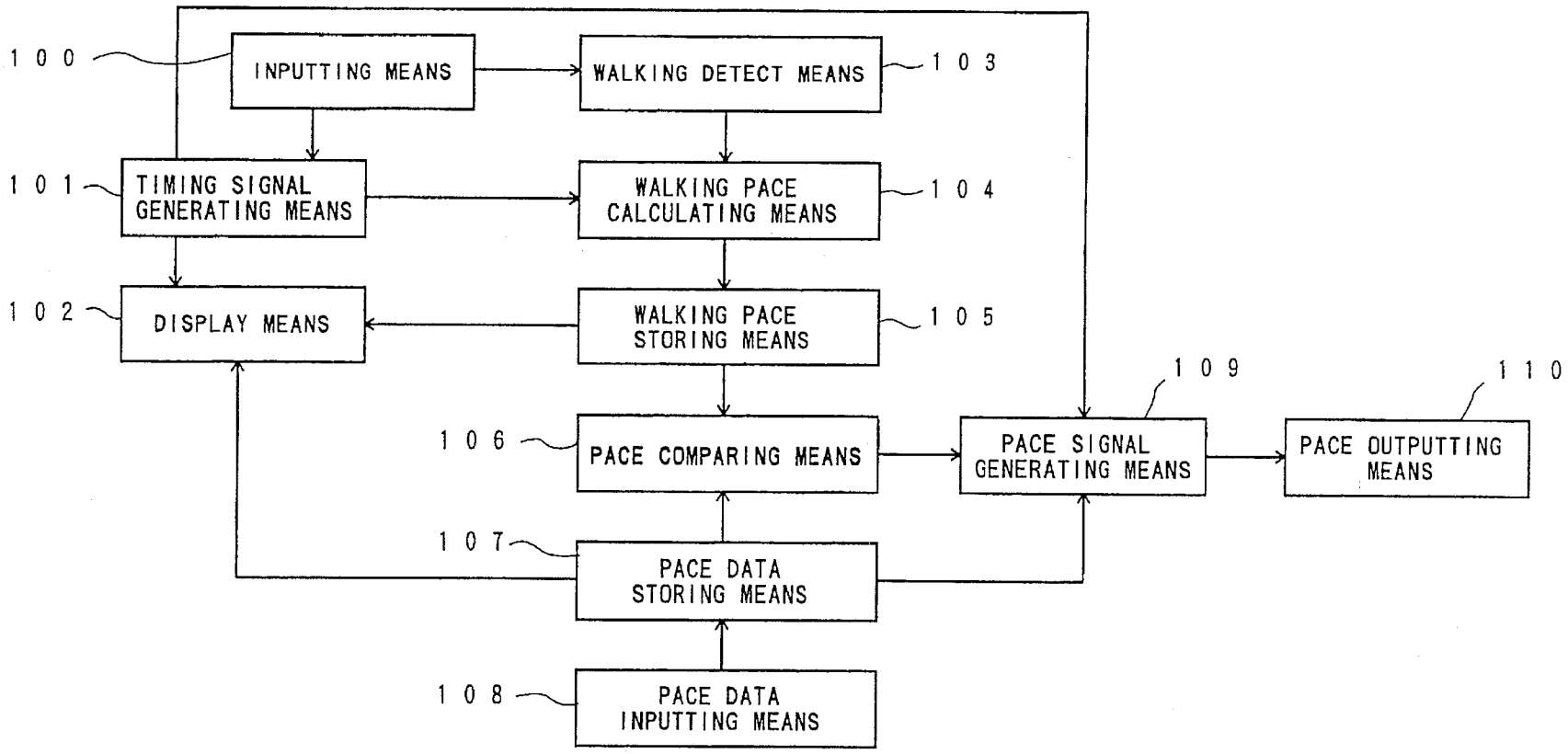
FIG. 1 is a function block diagram showing a typical construction of the inventive-pace generating device.

Hereinafter, the embodiments of the present invention will be explained referring to the drawings.

(1) First Embodiment

Figure 3:
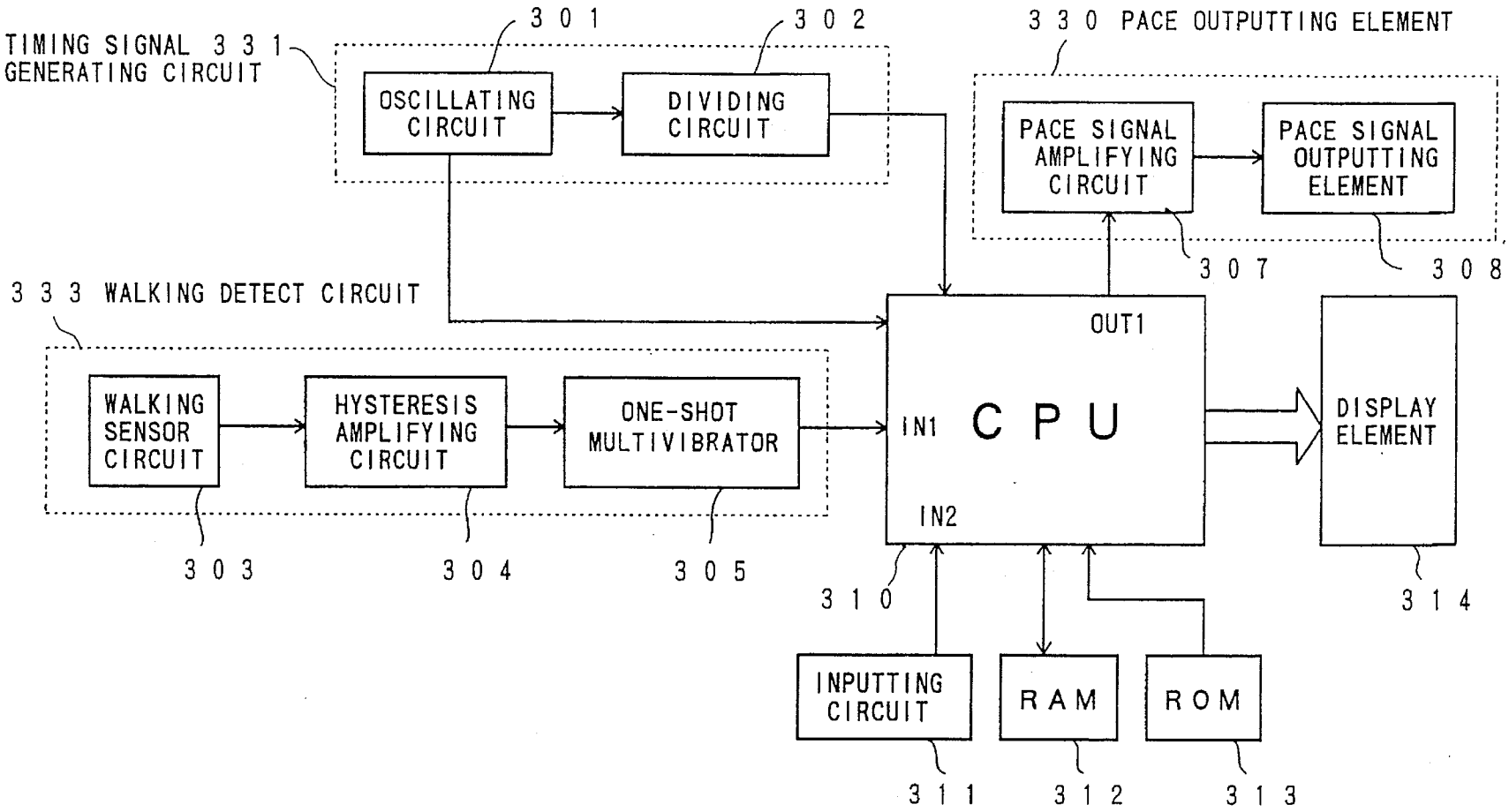
FIG. 3 is a function block diagram showing a first embodiment of the inventive pace generating device.

FIG. 3 is a function block diagram showing a first embodiment of the inventive pace generating device. The walking detect circuit 333 comprises a walking sensor circuit 303 for detecting a walking signal, a hysteresis amplifying circuit 304 for amplifying a detected walking signal detected by the walking sensor circuit 303, and a one-shot multivibrator 305 for receiving an amplified detected walking signal as trigger input and outputting a signal, and outputs a signal in accordance with walking. An output signal of an oscillating circuit 301 is inputted to a CPU 310 as a standard clock of the CPU 310, and simultaneously divided into a specified frequency by a dividing circuit 302 and then inputted to the CPU 310. The CPU 310 conducts a program stored in a ROM 313 in accordance with a standard clock outputted by the oscillating circuit 301. An inputting circuit 311 is connected to the CPU 310 and inputs a predetermined data such as a pace data thereto. The inputted data is displayed in a display element 314 and is stored in a RAM 312. The pace outputting element 330 comprises a pace signal amplifying circuit 307 and a pace signal outputting element 308, and outputs a pace signal outputted by the CPU 310.

Figure 4:
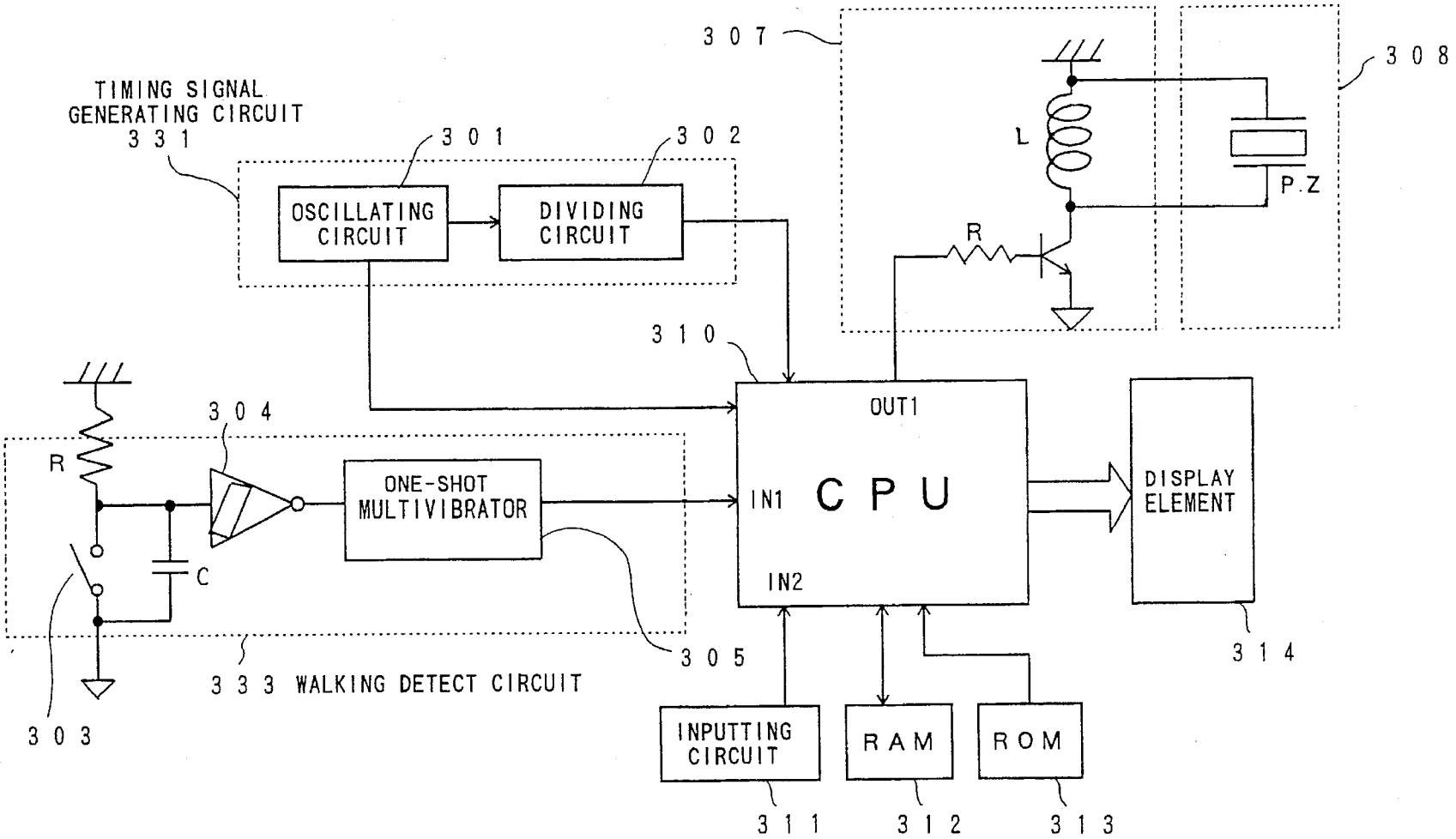
FIG. 4 is a circuit diagram showing the first embodiment of the inventive pace generating device.

FIG. 4 shows a concrete embodiment of a circuit shown in the function block diagram of FIG. 3. In FIG. 4, the walking sensor circuit 303 switches the contacts on and off in accordance with walking, and absorbs chattering of the contacts by means of a register R, a condenser C, and a schmitt trigger inverter 304. Next, a detected walking signal is inputted to a one-shot multivibrator 305 and then a one-shot pulse of a fixed pulse width is obtained. The one-shot multivibrator 305 is of non-retriggerable type which outputs a signal of a fixed pulse width when a signal is inputted to trigger input and ignores retrigger input during pulse output. This signal of a fixed pulse width is inputted to an input terminal IN1 of the CPU 310. The CPU 310 outputs a buzzer signal in accordance with a fixed pace signal in accordance with a fixed pace signal from OUT1. The buzzer signal is amplified by counter generating voltage of a coil or inductor L in the pace signal amplifying circuit 307. The pace outputting element 308 is a piezoelectric buzzer, which is driven by the pace signal amplified by the pace signal amplifying circuit 307.

Figure 9:
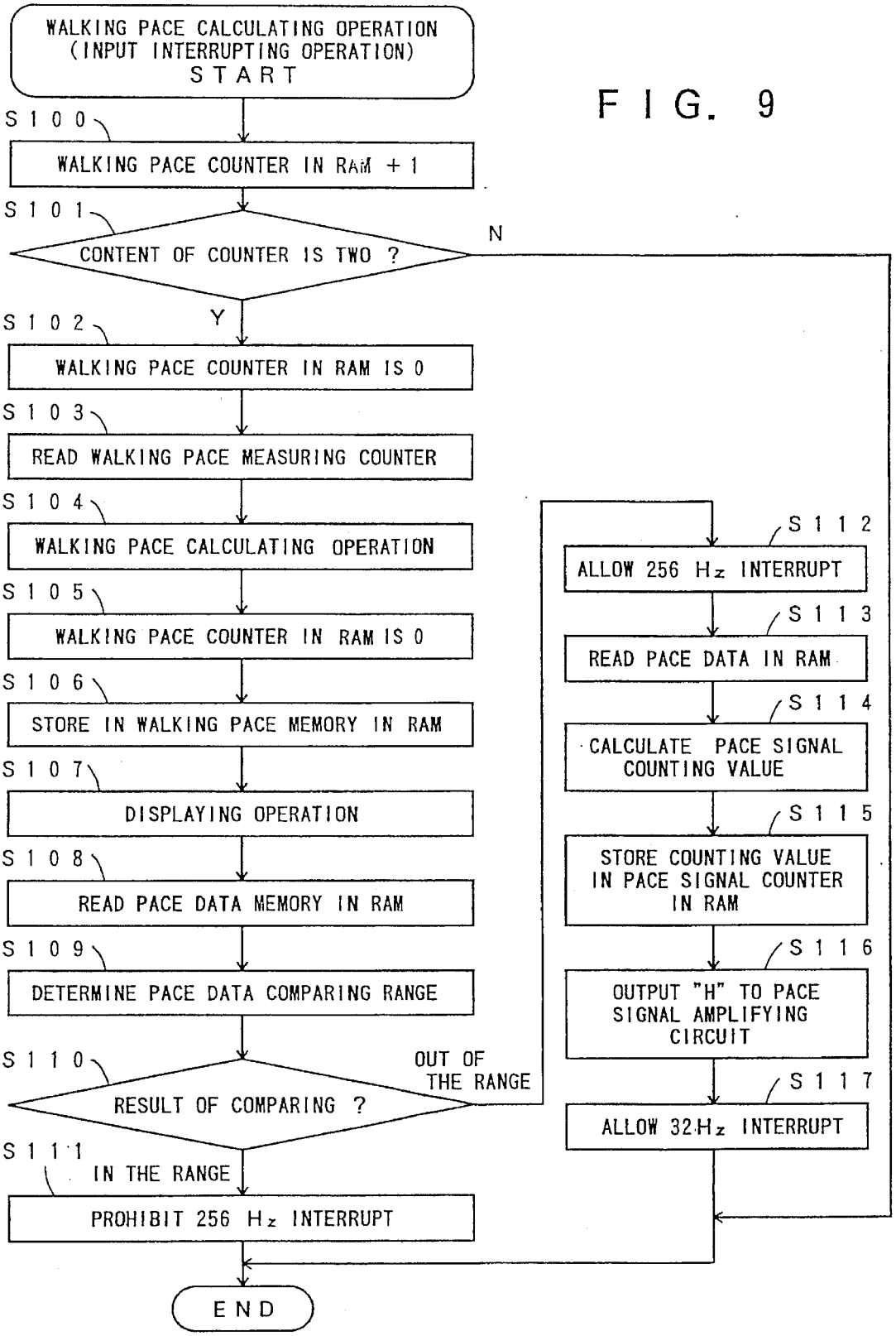
FIG. 9 is a flow chart showing an operating procedure of a CPU in the first embodiment of the inventive pace generating device.
Figure 10:
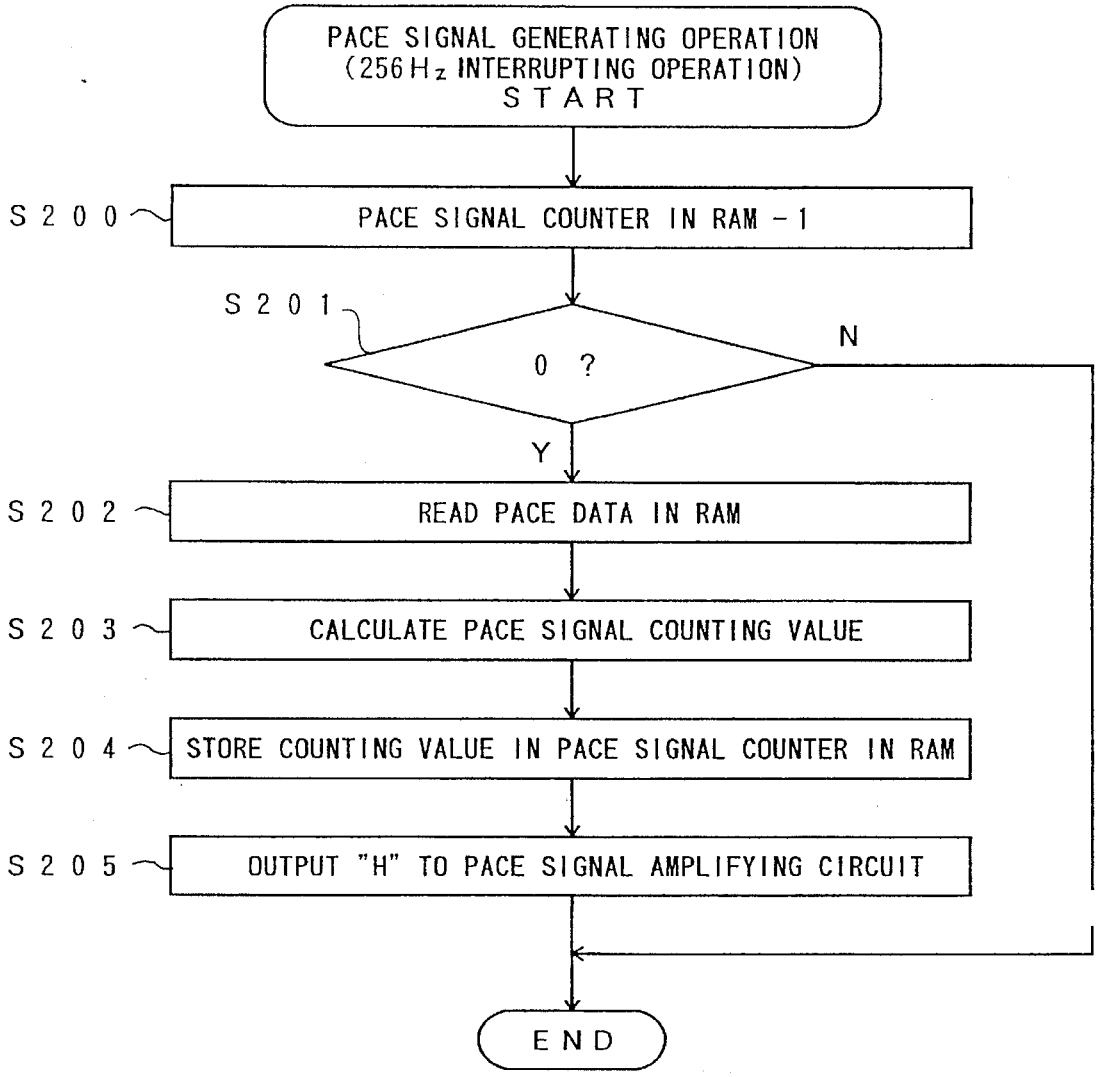
FIG. 10 is another flow chart showing an operating procedure of a CPU in the first embodiment of the inventive pace generating device.

Next, operation of the CPU 310 is described with reference to the flow charts of FIGS. 9 and 10. FIG. 9 is a flow chart showing an operation procedure of FIG. 3. When a signal accorded with a walking signal detected by a walking detect circuit 333 is inputted to the input terminal IN1 of the CPU 310, one is added to a walking pace counter in the RAM 312 at either a rising edge or a falling edge of the signal (S100). Then, in this step, the CPU Judges whether the input signal is the first input or the second one. When the contents of the walking pace counter in the RAM 312 is one, the CPU waits for a next signal to be inputted because it cannot measure a period of an inputted signal (S101). When the contents of the walking pace counter in the RAM 312 is two, the CPU moves on to period measurement of an input signal and clears the contents of the walking pace counter in the RAM 312 for the next measurement (S102). The CPU 310 receives a standard clock signal of the timing signal generating circuit 331 and then counts time. The counted time is read from a walking pace measuring counter in the RAM 312 (S103).

When a standard clock signal outputted by the dividing circuit 302 is 100 Hz and the contents of the walking pace measuring counter in the RAM 312 is 60, a period T of an input walking signal is calculated as follows:

$$T=1/100\times 0=0.6\ (\text{SEC}). \quad (1)$$

Pace is defined as the number of steps per minute, therefore the pace P is calculated as follows:

$$P=60\div 0.6=100\ (\text{STEP/MIN}). \quad (2)$$

As indicated, a walking pace is calculated (S104). This content is stored in the RAM 312 and displayed at the same time (S106, S107).

Next, the walking pace calculated above is compared with a desirable pace inputted in advance and stored in the RAM 312. Here, a permissible range of the difference between the walking pace and the predetermined pace has been determined beforehand. For example, if the predetermined pace data is 120 (STEP/MIN), the detected and calculated walking pace data is 100 (STEP/MIN), and the permissible range of the difference between both pace is −5 (STEP/MIN). In this case, the difference between both pace is 20 (STEP/MIN), which is out of the range (S108, S109, S110).

If the difference between both paces is within the range, the CPU does not generate a pace signal (S111). If the difference between both paces is out of the range, the CPU generates a pace signal. The pace signal is made by receiving a standard clock signal of 256 Hz, thereby being allowed to interrupt to the CFU 310 of 256 Hz (S112). The pace signal is made by counting the standard clock signal of 256 Hz. A counting value CD for outputting a predetermined pace is, when a predetermined pace is designated as PP, expressed as follows:

$$CD-60/PP\times 256. \quad (3)$$

Interrupting signals of 256 Hz are counted, and when they amount to the CD, then they turn a signal period for outputting a desirable predetermined pace (S113, S114). This CD is stored in a pace signal counter in the RAM 312 (S115). The CPU 310 outputs a buzzer signal "H" from an output terminal OUT1 to the pace signal amplifying circuit. A piezoelectric buzzer PZ (FIG. 4) receives this "H" signal and then outputs sounds (S116).

Here, a standard clock signal of 32 Hz is allowed to interrupt to the CPU in order to determine the length of the sound. When 32 Hz interrupts, CPU 310 counts 1 clock timing of 32 Hz signal. Then, at the next interruption, a buzzer signal "L" is outputted from an output terminal OUT1 of the CPU 10. In other words, the buzzer signal is outputted for 31.25 milli SEC (S117). FIG. 10 is a flow chart showing a procedure for making a pace signal. The operation is started by a 256 Hz interrupting signal. The counting data CD expressed as the formula (3) is stored in the pace signal counter in the RAM 312 and one is subtracted from the content of the counting data CD every time a 256 Hz signal interrupts (S200). When contents of the pace signal counter in the RAM 312 becomes zero, a counting value CD is newly calculated from a desirable predetermined pace with a formula (3) and then stored (S201, S202, S203, S204). Here, a buzzer signal "H" is newly outputted from an OUT1 terminal of the CPU 310 to the pace signal amplifying circuit 307.

(2) A second embodiment

Figure 2:
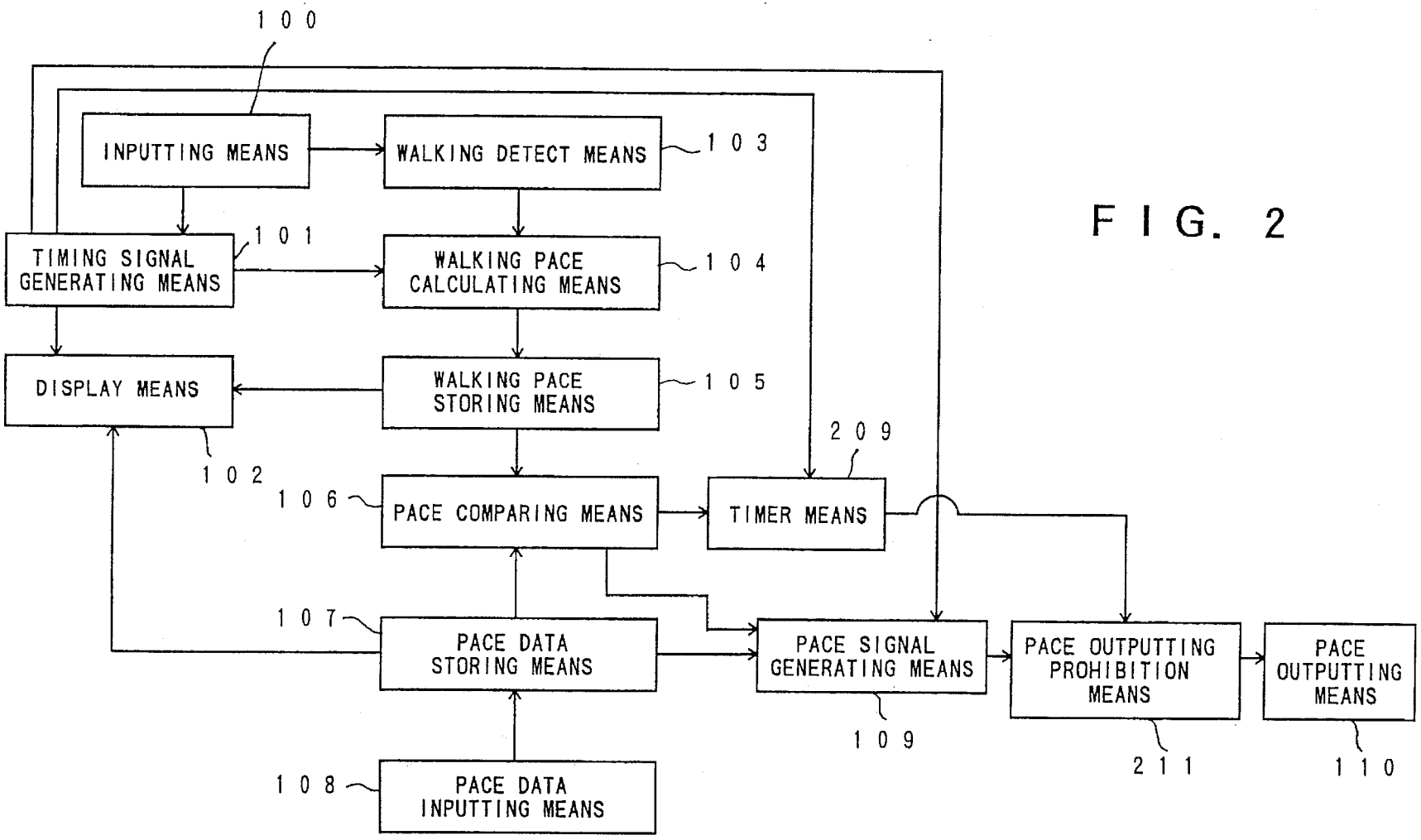
FIG. 2 is another function block diagram showing another typical construction of the inventive pace generating device.
Figure 11:
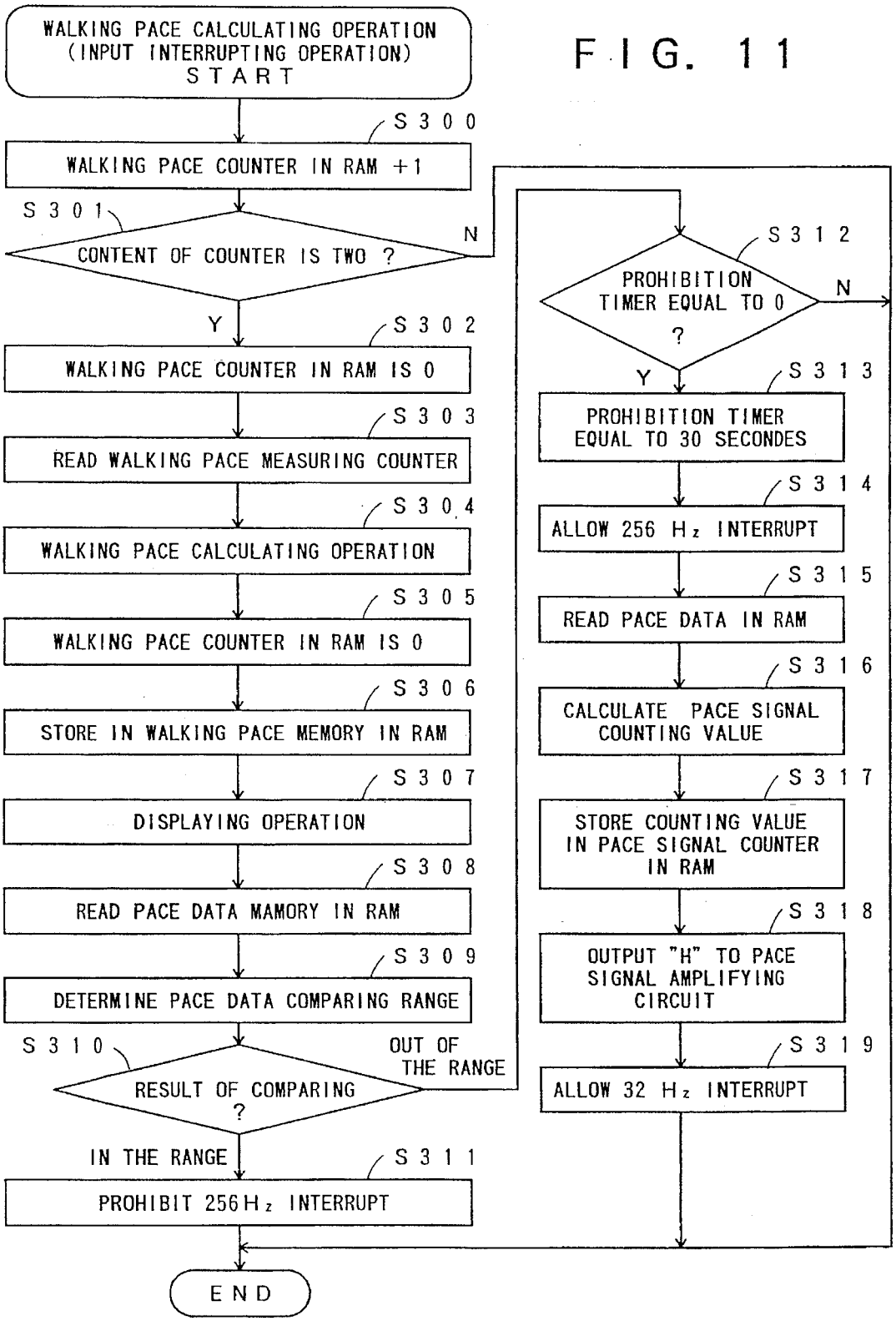
FIG. 11 is a flow chart showing an operating procedure of a CPU in the second embodiment of the inventive pace generating device.
Figure 12:
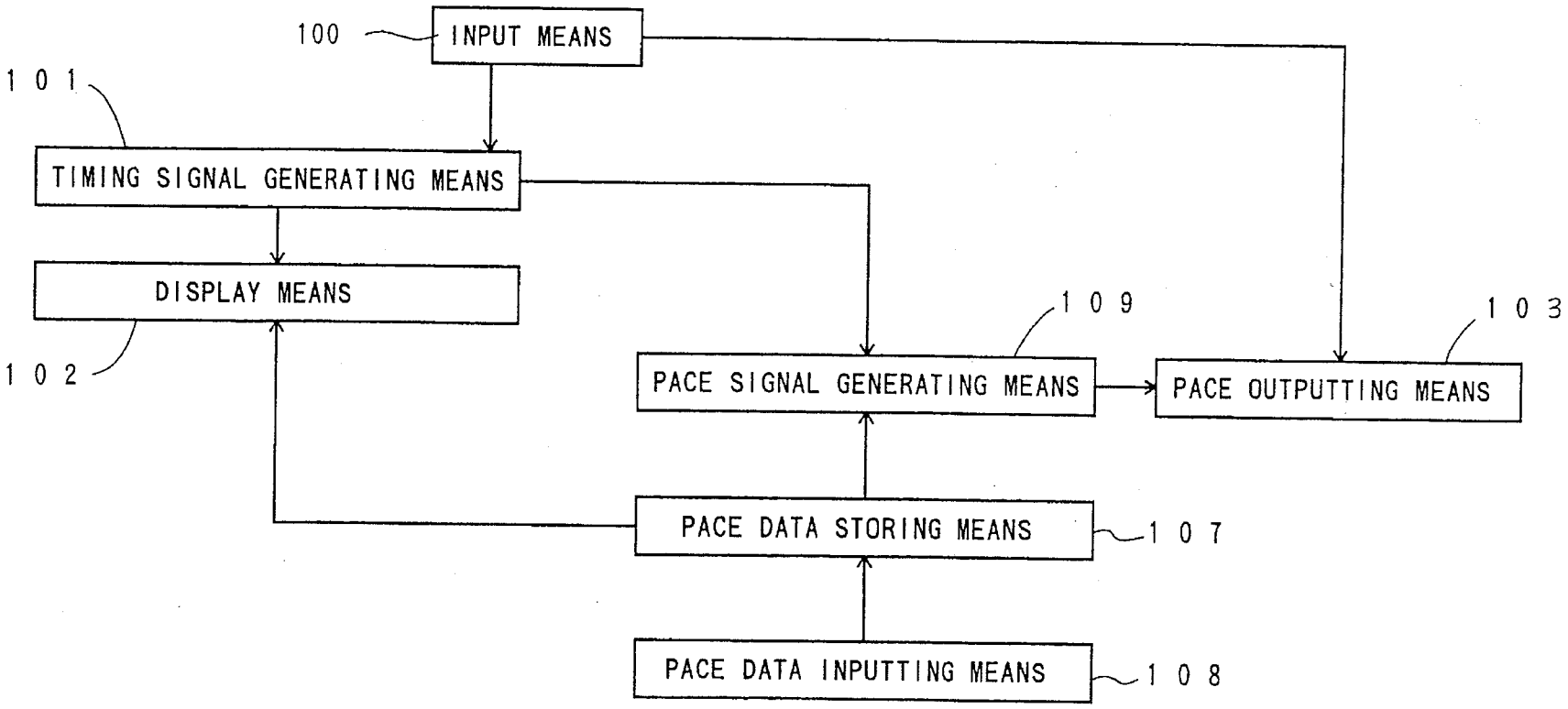
FIG. 12 PRIOR ART
FIG. 12 is a function block diagram showing a conventional pace generating device.

FIG. 11 is a flow chart showing a second embodiment of the inventive pace generating device. In FIG. 11, operating procedure of a walking pace calculating means 104 shown in FIG. 2 is explained in the first embodiment (S300~S310). Next, a calculated walking pace is compared with a desirable pace inputted in advance and stored in the RAM 312. When the result of comparison is out of a predetermined range, a timer starts to operate. If the timer is already operating, a data is not set to a prohibition timer (S312). On the other hand, if the timer is not yet operating, a time data of the timer is set to the prohibition timer counter. The prohibition timer is subtracted every interruption of a standard clock of 1 Hz. In this embodiment, time of the timer is 30 seconds (S313).

Next, the generation of a pace signal is described. A pace signal is made at 256 Hz of a standard clock, thereby being allowed to interrupt the CPU 310 (S314). Then the desirable predetermined pace is read out from the RAM 312 which stores the pace therein (S315). Next, a counting value is calculated for outputting a predetermined pace with a formula (3) shown in the first embodiment and then a buzzer signal "H" is outputted to e pace signal amplifying circuit so as to output a sound (S316~S319). In other words, a desirable pace inputted in advance and stored in the RAM 312 is compared with a detected and calculated walking pace and, as a result, when a difference between the above two paces is out of a permissible range, a desirable predetermined pace is outputted only for a fixed time.

(3) A third embodiment

Figure 5:
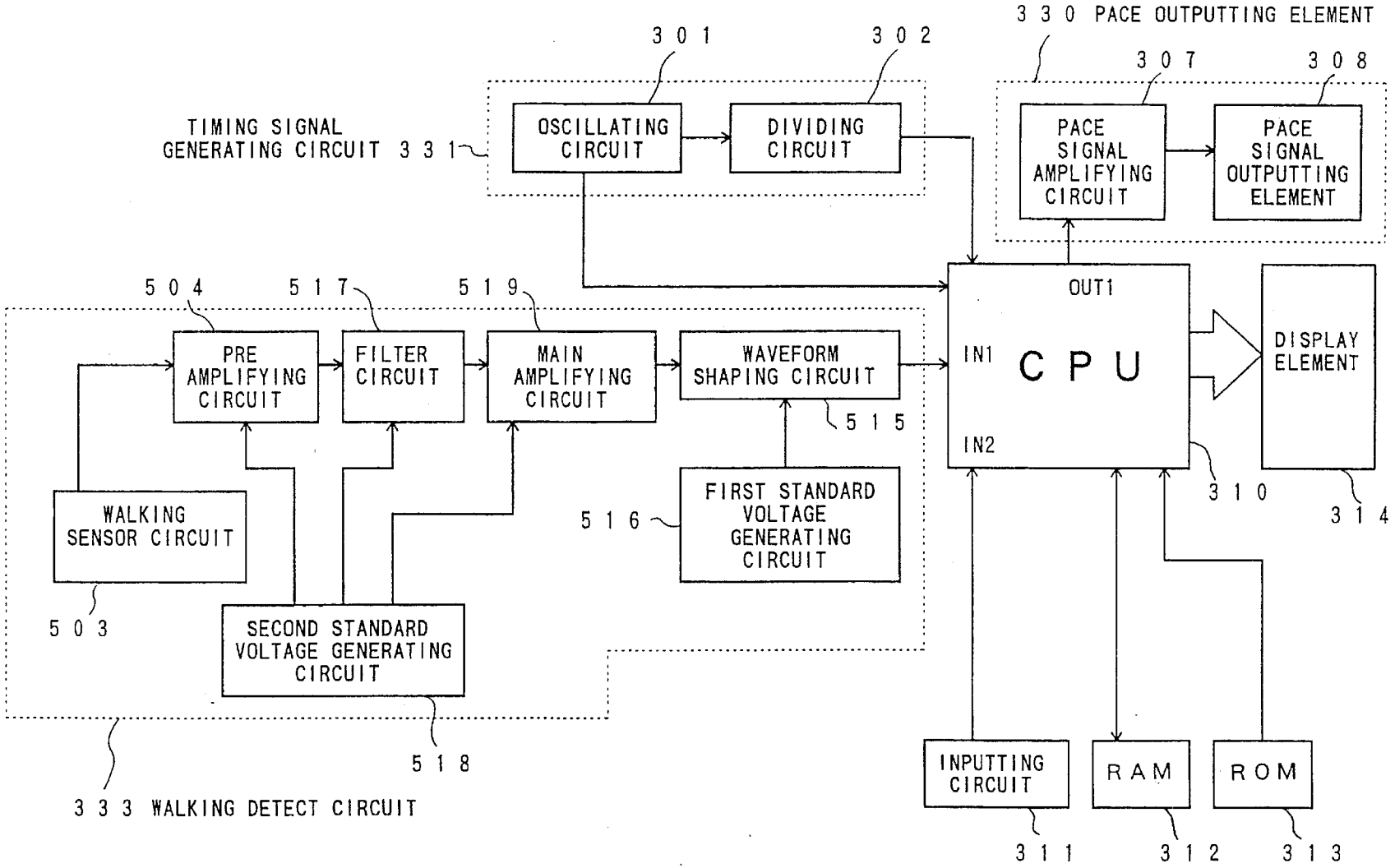
FIG. 5 is a function block diagram showing a second embodiment of the inventive pace generating device.

FIG. 5 is a function block diagram showing a third embodiment of the inventive pace generating device. A walking detect circuit 333 comprises a walking sensor circuit 503 which detects walking and then inputs a detect signal to a preamplifying circuit 504. The preamplifying circuit 504 amplifies and outputs a detect walking signal to a filter circuit 517. The filter circuit 517, of all frequency component of an inputted detect walking signal, shields commercial power-supply noise and so on, improves a S/N ratio, and outputs the detect walking signal to a main amplifying circuit 519. The main amplifying circuit 519 amplifies the detect walking signal adequately and outputs it to a waveform shaping circuit 515. A second standard voltage generating circuit 518 supplies a voltage which will be a standard to the preamplifying circuit 504, the filter circuit 517, and the main amplifying circuit 519. The waveform shaping circuit 515 receives a standard voltage outputted from a first standard voltage generating circuit 516 and transforms detect walking signals from analog signals to digital signals "H" and "L". Then the transformed signal corresponding to the walking signal is inputted to an IN1 terminal of the CPU 310. Operation of the CPU 310 is the same as that of the first embodiment and the second embodiment.

Figure 6:
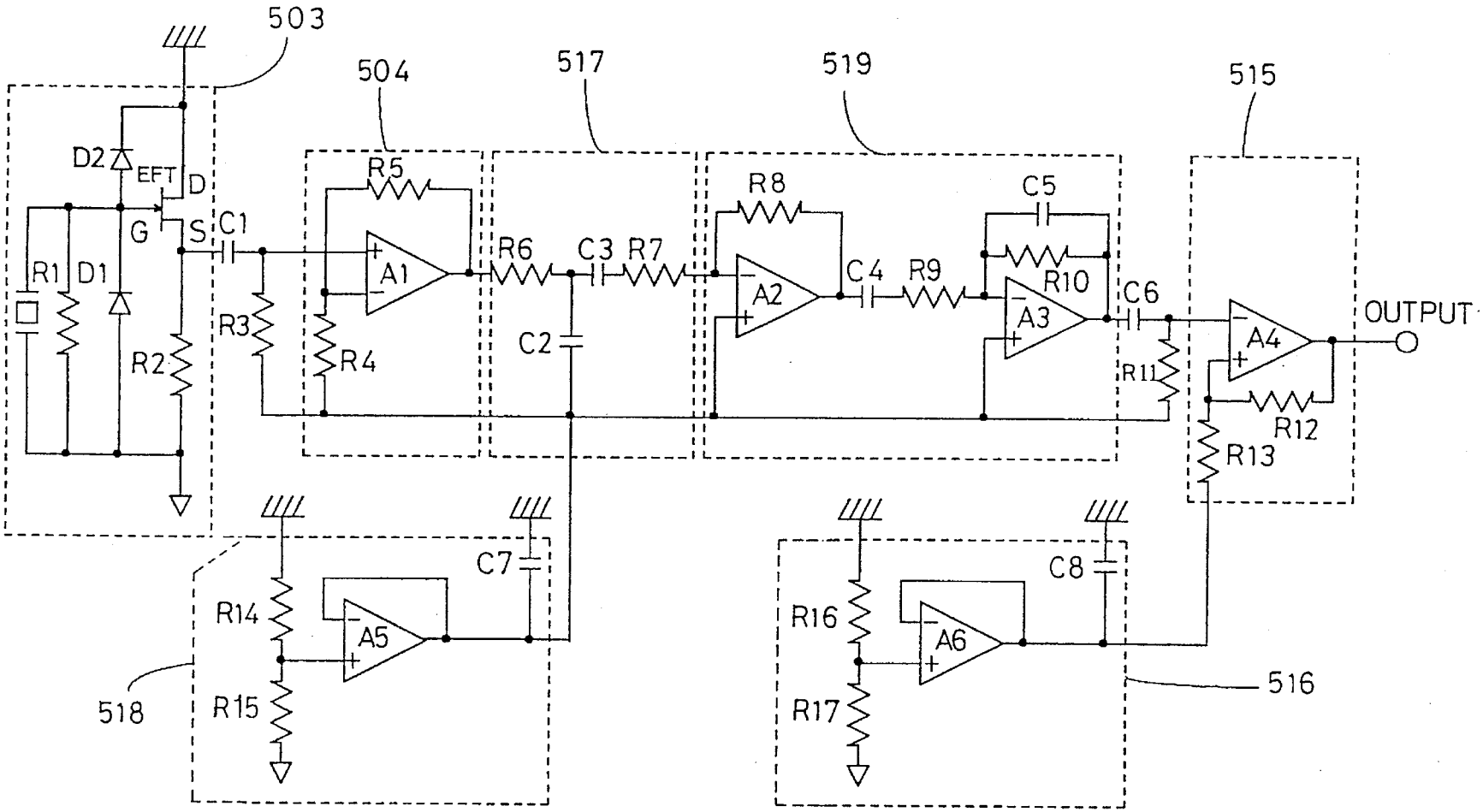
FIG. 6 is a circuit diagram showing the second embodiment of the inventive pace generating device.

FIG. 6 is a specific circuit embodiment of the walking detect circuit 333 shown in the function block diagram of FIG. 5. In FIG. 6, the walking sensor circuit 503 outputs a transformation caused by the vibration corresponding to a walking functioning as an electric charge, with a sensor having a cantilever structure and piezoelectric elements adhered thereto. Impedance conversion is conducted to an outputted walking signal by way of EFT and then the walking signal is outputted to an OP amplifier A1 through an AC coupling condenser C1. The preamplifying circuit 504 amplifies a detect walking signal at an amplifying rate of 1+R5/R4. The filter circuit 517 exhibits a filter characteristic that a low cut-off frequency Fcl is $1/(2\pi C2R6)$ and a wide cut-off frequency Fch is $1/(2\pi C3R7)$. A detect walking signal amplified adequately by the main amplifying circuit 519 is inputted to a hysteresis comparator A4 of the waveshape forming circuit 515 and then outputted to an OUTPUT terminal.

Figure 7:
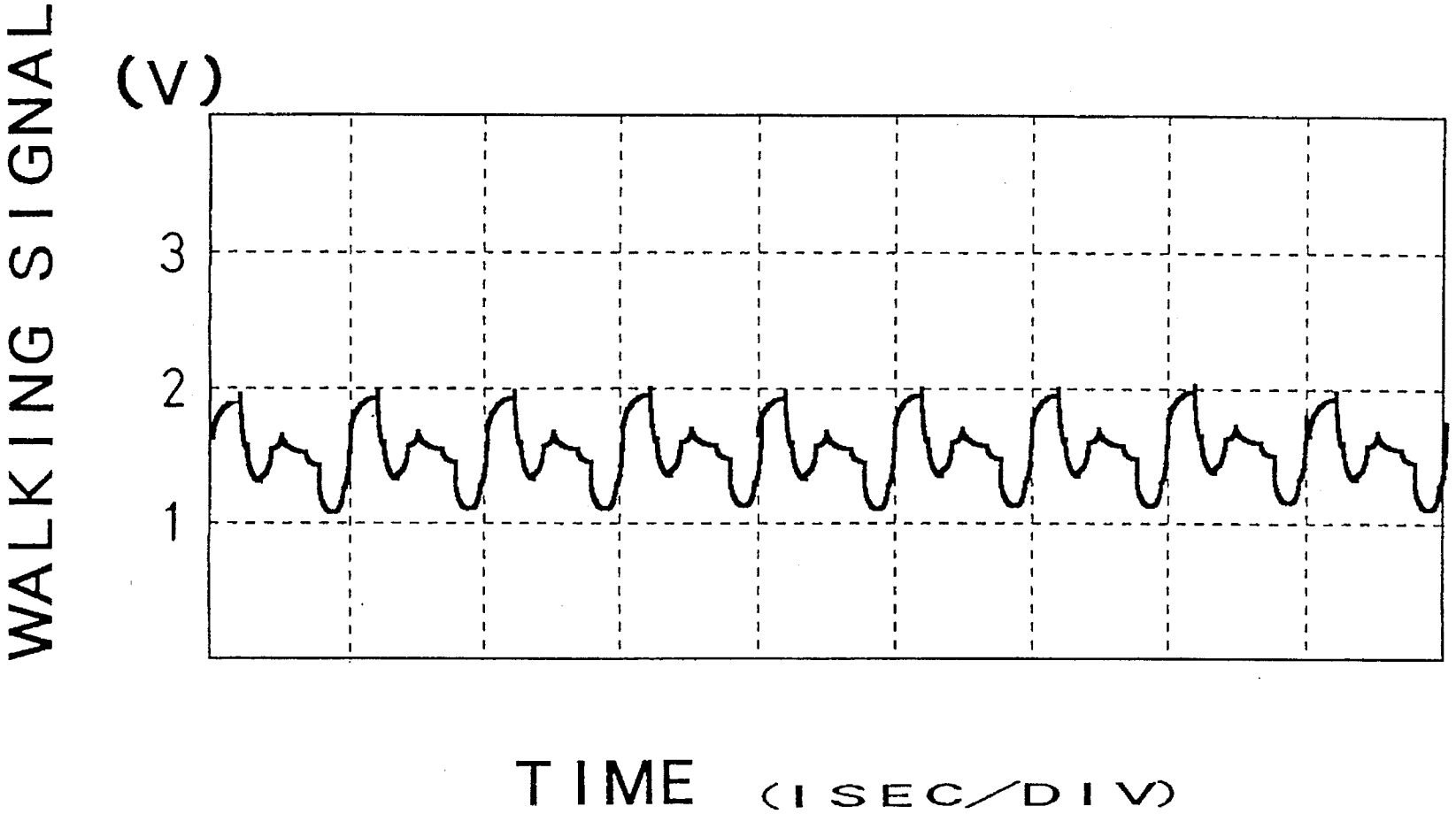
FIG. 7 is a chart showing a signal-waveform of the second embodiment of the inventive pace generating device.

FIG. 7 is a waveform showing a detect walking signal at an input terminal of the hysteresis comparator A4 of the waveform shaping circuit 515 shown in FIG. 6.

Figure 8:
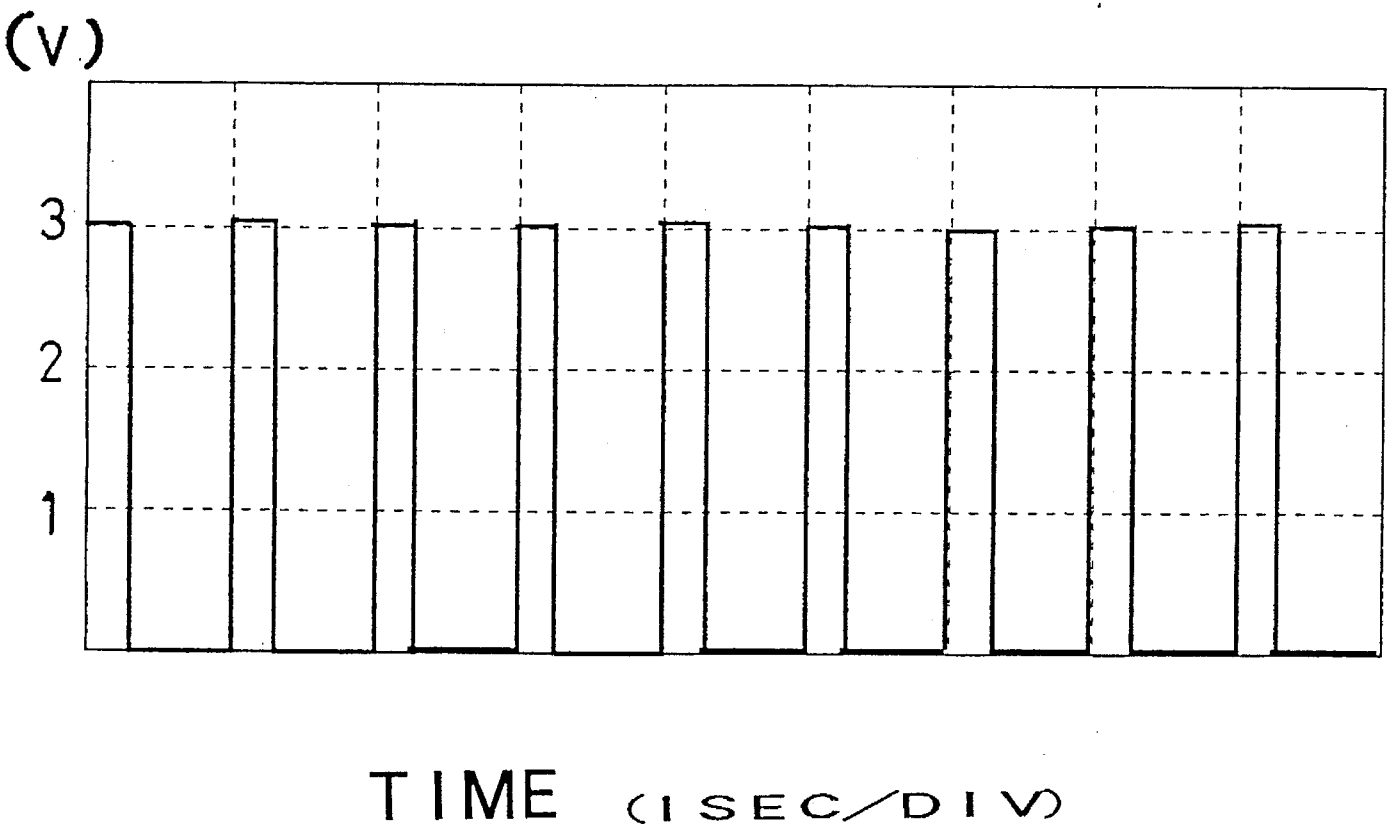
FIG. 8 is another chart showing a signal-waveform of the second embodiment of the inventive pace generating device.

FIG. 8 is another signal-waveform at the output terminal OUTPUT of the hysteresis comparator A4 of the waveform shaping circuit 515 shown in FIG. 6. This signal is inputted to the IN1 terminal of the CPU 310. In this embodiment, a piezoelectric sensor is used for the walking sensor circuit. However, the walking sensor circuit is not restricted to the piezoelectric sensor as long as it can detect walking. Additionally, a pace outputting means 110 is illustrated with a piezoelectric buzzer in this embodiment. However it is not restricted to the piezoelectric buzzer.

The present invention, as described above, compares a detect walking pace with a desirable predetermined pace and then outputs the predetermined pace only when the difference between the above two paces is out of the predetermined possible range as a result of the above comparison. Therefore users can find automatically a predetermined pace without ceasing their exercise. Furthermore, providing a timer which is activated depending on the result of the comparison between both paces makes it possible to stop outputting a desirable predetermined pace after a fixing time elapses. Consequently, the consumption of power is reduced. When an exerciser gets exercise at a walking pace which is very unlike a desirable predetermined pace, the inventive device outputs the desirable predetermined pace so as to improve, for example, a leaning effect of the exercise.

What is claimed is:

1. A pace generating device comprising: pace data storing means for storing predetermined pace data and generating a predetermined pace data signal; walking detector means for detecting the motion of walking and outputting a detection signal; walking pace calculating means for calculating a walking pace based on the detection signal from the walking detector means and outputting a walking pace signal; walking pace storing means for storing the walking pace signal and outputting a walking pace display signal corresponding to the walking pace signal; pace comparing means for comparing the walking pace signal stored in the walking pace storing means with the predetermined pace data signal stored in the pace data storing means and outputting a pace generating instruction signal when the walking pace signal is out of a predetermined range; pace signal generating means for generating a pace signal from the predetermined pace data stored in the pace data storing means when the pace generating instruction signal is outputted from the pace comparing means; and pace outputting means for outputting a walking pace signal corresponding to the pace signal outputted by the pace signal generating means.

2. A pace generating device according to claim 1; further comprising timing signal generating means for counting time and generating a standard clock signal; timer means for receiving the standard clock signal from the timing signal generating means, counting a predetermined time period when the pace generating instruction signal is outputted from the pace comparing means, and outputting a time-up signal when the counting of the predetermined time period has ended; and pace output prohibiting means for receiving the pace signal outputted by the pace signal generating means and the time-up signal outputted by the timer means, and prohibiting the pace signal generating means from outputting a pace signal to the pace outputting means.

3. A pace generating device according to claim 1; wherein the walking detector means comprises a walking sensor circuit for detecting the motion of walking and outputting a detection signal; a hysteresis amplifying circuit for amplifying the detection signal outputted by the walking sensor circuit; and a one-shot multivibrator for receiving the detection signal amplified by the hysteresis amplifying circuit and outputting a pulse signal in accordance with the motion of walking.

4. A pace generating device according to claim 3; further comprising sound producing means for receiving the pulse signal outputted by the one-shot multivibrator and producing an audible sound in response to the pulse signal.

5. A pace generating device according to claim 1; wherein the walking detector means comprises a walking sensor circuit having a piezoelectric sensor.

6. A pace generating device according to claim 1; wherein the walking detector means comprises a walking sensor circuit for detecting the motion of walking and outputting a detection signal; a preamplifying circuit for receiving, amplifying and outputting the detection signal outputted by the walking sensor circuit; a filter circuit for receiving, filtering and outputting the detection signal outputted by the preamplifying circuit; a main amplifying circuit for receiving, amplifying and outputting the detection signal outputted by the filter circuit; a waveform shaping circuit for receiving the detection signal from the main amplifying circuit; a first voltage generating circuit for supplying a voltage to the waveform shaping circuit whereby the waveform shaping circuit transforms the detection signal from an analog detection signal to a digital detection signal; and a second voltage generating circuit for supplying a voltage to the preamplifying circuit, the filter circuit and the main amplifying circuit.

7. A pace generating device according to claim 6; further comprising sound producing means for receiving the digital detection signal and producing an audible sound in response to the digital detection signal.

8. A pace generating device comprising:

pace data inputting means for inputting predetermined pace data;

pace data storing means for storing the predetermined pace data and generating a predetermined pace data signal;

timing signal generating means for counting time and generating a standard clock signal;

walking detector means for detecting the motion of walking and outputting a detection signal;

walking pace calculating means for receiving the detection signal outputted by the walking detector means and the standard clock signal generated by the timing signal generating means, calculating a walking pace based on the detection signal and the standard clock signal, and outputting a walking pace signal;

walking pace storing means for receiving the walking pace signal outputted by the walking pace calculating means, storing the walking pace signal, and outputting a walking pace display signal corresponding to the walking pace signal;

display means for displaying the predetermined pace data signal stored in the pace data storing means, the walking pace display signal outputted by the walking pace storing means, and the timing signal outputted by the timing signal generating means;

pace comparing means for comparing the walking pace signal stored in the walking pace storing means with the predetermined pace data signal stored in the pace data storing means, and outputting a pace generating instruction signal when the walking pace signal is out of a predetermined range;

pace signal generating means for generating a pace signal from the predetermined pace data stored in the pace data storing means and a standard clock signal outputted by the timing signal generating means when the pace generating instruction signal is outputted from the pace comparing means; and pace outputting means for outputting a pace signal corresponding to the pace signal outputted by the pace signal generating means.

9. A pace generating device according to claim 8; further comprising timer means for receiving the standard clock signal outputted by the timing signal generating means, counting a predetermined time period when the pace generating instruction signal is outputted from the pace comparing means, and outputting a time-up signal when the counting of the predetermined time period has ended; and pace output prohibiting means for receiving a pace signal outputted by the pace signal generating means and the time-up signal outputted by the timer means, and prohibiting the pace signal generating means from outputting a pace signal to the pace outputting means.

10. A pace generating device according to claim 8; wherein the walking detector means comprises a walking sensor circuit for detecting the motion of walking and outputting a detection signal; a hysteresis amplifying circuit for amplifying the detection signal outputted by the walking sensor circuit; and a one-shot multivibrator for receiving the detection signal amplified by the hysteresis amplifying circuit and outputting a pulse signal in accordance with the motion of walking.

11. A pace generating device according to claim 10; further comprising sound producing means for receiving the pulse signal outputted by the one-shot multivibrator and producing a sound in response to the pulse signal.

12. A pace generating device according to claim 8; wherein the walking detector means comprises a walking sensor circuit having a piezoelectric sensor.

13. A pace generating device according to claim 8; wherein the walking detector means comprises a walking sensor circuit for detecting the motion of walking and outputting a detection signal; a preamplifying circuit for receiving, amplifying and outputting the detection signal outputted by the walking sensor circuit; a filter circuit for receiving, filtering and outputting the detection signal outputted by the preamplifying circuit; a main amplifying circuit for receiving, amplifying and outputting a detection signal outputted by the filter circuit; a waveform shaping circuit for receiving a detection signal from the main amplifying circuit; a first voltage generating circuit for supplying a voltage to the waveform shaping circuit to enable the waveform shaping circuit to transform the detection signal from an analog detection signal to a digital detection signal; and a second voltage generating circuit for supplying a voltage to the preamplifying circuit, the filter circuit and the main amplifying circuit.

14. A pace generating device according to claim 13; further comprising sound producing means for receiving the digital detection signal and producing an audible sound in response to the digital detection signal.

* * * * *